United States Patent [19]

Too et al.

[11] Patent Number: 4,483,739

[45] Date of Patent: Nov. 20, 1984

[54] COMPOSITIONS AND METHOD FOR STRIPPING GOLD FROM COPPER SUBSTRATES

[75] Inventors: Elena H. Too, Nutley; Daniel R. Marx, Montclair, both of N.J.

[73] Assignee: OMI International Corporation, Warren, Mich.

[21] Appl. No.: 579,154

[22] Filed: Feb. 16, 1984

[51] Int. Cl.[3] ..... C23F 1/02; B44C 1/22; C03C 15/00; C03C 25/06

[52] U.S. Cl. ..... 156/656; 75/105; 156/664; 252/79.5

[58] Field of Search ..... 156/656, 664; 252/79.1, 252/79.4, 79.5, 541, 544, 545, 156, 141, 142, 151; 75/97 R, 100, 105, 107

[56] References Cited

U.S. PATENT DOCUMENTS

| | | | |
|---|---|---|---|
| 2,649,361 | 8/1953 | Springer et al. | 252/79.1 X |
| 3,102,808 | 9/1963 | Weisberg et al. | 156/656 X |
| 3,242,090 | 3/1966 | Grunwald | 252/79.1 |
| 3,935,005 | 1/1976 | Solidum et al. | 252/79.1 X |

*Primary Examiner*—William A. Powell

*Attorney, Agent, or Firm*—Richard P. Mueller

[57] ABSTRACT

An improved composition for selectively stripping gold from a metal substrate, especially copper metal, wherein the gold deposit is rapidly and effectively stripped without an attendant attack on the metal substrate. A minor amount of an organo mercapto compound, e.g. mercaptobenzothiazole, is added to the stripping composition to inhibit attack on the metal substrate.

15 Claims, No Drawings

COMPOSITIONS AND METHOD FOR STRIPPING GOLD FROM COPPER SUBSTRATES

BACKGROUND OF THE INVENTION

The present invention relates to a composition for stripping gold coatings from copper substrates. More particularly, the invention is concerned with a stripping composition and method which will rapidly remove gold that has been deposited by electroplating or chemical plating techniques on copper substrates and which will not attack the copper substrate.

In the plating art various compositions have been proposed for stripping gold metal coatings or deposits from metal substrates. In general, these prior art methods for stripping the gold involve the use of chemical formulations containing a soluble cyanide, e.g. sodium or potassium cyanide, a ring-substituted nitrobenzene acid compound as an oxidizing agent, and a small amount of a lithium, lead or bismuth compound for accelerating the stripping action. It has been recognized that the use of an aqueous solution from the aforementioned chemical composition can effectively strip gold and gold alloys off nickel, nickel alloy, and Kovar substrates by immersion with a minimum or substantially no attack on the metal substrate. However, it also has been appreciated that when the same solutions are used for stripping gole deposits from a copper substrate severe attack of the copper substrate results.

The recent Solidum et al. U.S. Pat. No. 3,935,005, which issued Jan. 27, 1976, provides the background as well as the problems associated with the removal of deposited gold metal from copper substrates. In this patent the reasons for the need for such stripping solutions in the plating industry is delineated along with discussions of known stripping solutions. The prior patents to Springer et al. U.S. Pat. No. 2,649,361 and Grunwald U.S. Pat. No. 3,242,090 are discussed by Solidum. Referring first to Springer, it is noted that this patent discloses a stripping composition comprising sodium cyanide, sodium nitrobenzene sulphonate, and sodium hydroxide. Grunwald, on the other hand, discloses a stripping composition comprising a complex metal tetracyanide salt, a nitro substituted aromatic compound such as nitrobenzene sulphonic acid, nitrobenzoic acid, nitrochlorobenzene, nitrophenol and nitrobenzaldehyde. The complex salt component of the Grunwald composition is formed from a metal selected from the group consisting of zinc, cadmium and copper.

As noted by Solidum, the compositions of the Springer and Grunwald patents have been extensively utilized as strippers of gold from various types of substrates. Nevertheless, two major deficiencies of such stripping compositions were found. Firstly, the stripping compositions have not removed the metal deposits as rapidly as might be commercially desirable. Secondly, these compositions have a tendency to attack various metal substrates such as copper.

The invention of Solidum was to overcome, inter alia, these deficiences. It is directed to a dry powder stripping composition for addition to water and to form thereby, an aqueous solution for stripping gold and silver deposits from a variety of substrates. The composition disclosed by Solidum calls for the presence of a major proportion of a soluble cyanide compound selected from the group consisting of alkali metal cyanide, ammonium cyanide and mixtures thereof. Other components in the stripping composition include a soluble lithium compound; a soluble compound of a metal ion selected from the group consisting of lead, bismuth, and mixtures thereof; and a ringsubstituted nitrobenzene acid compound. The latter is selected from the group consisting of alkali metal and ammonium salts of methyl-nitrobenzoic acid, chloro-nitrobenzene sulfonamide, amino nitrobenzoic acid, and chloronitrobenzoic acid.

Although the Solidum stripping composition is stated to rapidly strip gold and silver from such substrates as stainless steel, nickel, molybdenum and alloys of iron, nickel cobalt and manganese; there still is a problem when copper is the substrate. More particularly, Solidum states that with a copper substrate the period of immersion has to be closely controlled since the stripping composition will attack the copper substrate.

SUMMARY OF THE INVENTION

In accordance with the present invention it has now been discovered that gold deposits can be rapidly stripped from copper substrates without producing any substantial attack on the base material provided the stripping composition contains a minor amount of an organic compound containing a nitrogen heterocyclic ring structure and a thiol group. The preferred additive is a heterocyclic compound with five or six member rings containing both nitrogen and a sulphur constituent as well as a thiol group. Especially preferred compounds are the mercaptobenzothiazoles. It is also preferred that the stripping composition contain a nitro-substituted aromatic organic compound, an alkali metal cyanide, and a lead compound as an auxiliary agent.

Operating at temperautres from 25° to 55° C., the stripping solution of this invention is capable of removing at least one micron of gold or bold alloy deposits within commercially acceptable time periods with substantially no attack on the copper substrate. It has been further found that this stripping composition is especially well suited for applications where the protection of the copper base metal or the ease of gold metal recovery from the spent solution are improtant considerations.

DETAILED DESCRIPTION OF THE INVENTION

As previously noted, the stripping composition of this invention may contain a variety of components used previously for stripping metal deposits, especially gold and silver deposits that have been plated on various metal substrates. In general, all of the components will be water soluble. Major components will include a ring-substituted nitrobenzoic acid compound including nitrobenzoic acid itself as well as the alkali metal and ammonium salts of nitrobenzoic acid. Specific compounds include p-nitrobenzoic acid, potassium 2-chloro-4-nitrobenzoic acid, sodium 3-methyl-2-nitrobenzoic acid; potassium 3-methyl-6-nitrobenzoic acid, sodium 4-chloro-3-nitrobenzoic acid, and the like which are well known in the art and which are disclosed in the Solidum patent referred to above.

The amount of the nitrobenzene acid compound utilized in the stripping composition in this invention typically may range from about 5 to 60 grams/liter, preferably 15 to 30 grams/liter.

Another component is a bath soluble cyanide. Although the use of potassium cyanide is preferred, other cyanides that can be advantageously employed include sodium cyanide, lithium cyanide, or other alkali metal cyanides, ammonium cyanide, etc. This component will be present in the stripping composition in amounts typically ranging from about 5 to 50 grams/liter, and preferably from about 10 to 25 grams/liter.

The auxiliary agent that is advantageously utilized in formulating the preferred stripping composition may be any suitable lead or bismuth compound that does not have any interfering anion group. As disclosed by Solidum, suitable anions include acetate, citrate, chloride, oxide and hydroxide. The lead compounds are generally utilized, lead chloride and lead oxide being especially preferred. The auxiliary agent will be present in amounts typically ranging from 0.1 to 1.0 gram/liter, preferably 0.2 to 0.5 gram/liter.

In will be further understood that other components that have been conventionally used in metal stripping compositions may also be utilized here provided that they do not adversely affect the ability of the stripping solution to remove the gold deposit from the copper metal substrate. Thus, for example, alkali metal hydroxides or other alkaline materials may be utilized to ensure that the stripping composition has an alkaline pH which is typically from about 11 to 14 pH, preferably from 12.5 to 13.5 pH.

The essential additive in the present invention is an organo mercapto compound. Preferably, the organo mercapto compound is a five or six member ring containing nitrogen and sulfur as well as a thiol group; especially preferred is the 2-mercapto-compounds such as 2-mercaptobenzothiazole (MBT). It will be understood, however, that similar compounds may also be employed such as mercaptobenzothiazolines, mercaptoimidazoles, 2-mecapto-3-pyridinols, 2-mercaptopyrimidines, 2-mercaptobenzoxazoles and the like. These mercapto organic compounds are employed in amounts typically ranging from about 0.1 to 5.0 grams/-liter and preferably 0.5 to 2.0 grams/liter.

All of the foregoing components of the stripping compositions of the present invention will be present in amounts at least sufficient to provide, in combination, the desired stripping rate without substantial attack on the substrate. Typically, the amounts used are within the specific ranges set forth.

For most purposes the stripping solution of this invention is utilized at the pH mentioned above and at temperatures typically ranging from about 25° to 55° C. Preferred temperatures of operation range from about 35° to 50° C. Other conventional stripping conditions may also be employed, as will be well known to those skilled in this art. It is important, however, that such operating conditions be employed that will not interfere with the effective stripping of the gold or gold alloy deposits from the copper substrates while, at the same time, avoiding any substantial dissolution of the copper metal substrate.

The disclosures in the Solidum U.S. Pat. No. 3,935,005 are incorporated herein by reference, including the method of using the gold stripping solution by contacting the surface of the workpiece either utilizing immersion techniques or spraying techniques. However, for most purposes the immersion techniques of the prior art are preferred in order to ensure substantial removal of the gold or gold alloy deposits from the copper substrate. Contact times will vary, of course, depending on the nature and size of the workpieces involved. As will be demonstrated below, use of the stripping compositions of this invention have shown that the immersion period may last at least 30 minutes without evidence of any attack on the copper substrate. Such immersion times would not have been possible utilizing the stripping compositions of the prior art, since as discussed above their potential attack on copper substrates was noted.

In some operations moderate solution agitation is preferred and this can be readily carried out using conventional mixing equipment.

Preferred gold stripping compositions according to the invention are as follows:

| Components | Concentration, g/l | |
|---|---|---|
| | General | Preferred |
| Nitro-substitute Benzoic Acid | 5–60 | 15–30 |
| Soluble Cyanide Salt | 5–50 | 10–25 |
| Alkali Metal Hydroxide | 5–100 | 20–50 |
| Lead or Bismuth Compound | 0.1–1 | 0.2–0.5 |
| Mercapto Organo Compound | 0.1–5 | 0.5–2.0 |

The present invention will be more fully understood by reference to the following illustrative examples wherein the temperatures are given in degrees C.

EXAMPLE 1

A gold stripping composition was prepared by dissolving the following ingredients in water:

| Component | Concentration, g/l |
|---|---|
| p-Nitrobenzoic Acid | 12 |
| Potassium 2-chloro-4-nitrobenzoate | 5 |
| Potassium Hydroxide | 20 |
| Lead Chloride | 0.4 |
| Potassium Cyanide | 15 |
| 2-Mercaptobenzothiazole | 1 |

The resulting stripping solution had a pH of 13–13.5 and was used at a temperature of 43°–45° C. with moderate agitation. When a gold plated copper substrate was immersed in the solution the gold stripping rate was 1.2–1.4 microns per minute. No attack on the copper substrate was detected even after it was in direct contact with the stripping solution for 30 minutes.

EXAMPLE 2

Another aqueous gold stripping composition was formulated as in Example 1 from the following ingredients:

| Components | Concentration, g/l |
|---|---|
| p-Nitrobenzoic Acid | 25 |
| Potassium Hydroxide | 15 |
| Potassium 2-chloro-4-nitrobenzoate | 5 |
| Lead Oxide | 0.5 |
| Potassium Cyanide | 15 |
| 2-Mercaptobenzothiazole | 1 |

The pH of the resulting solution was 12.5. When it was used to remove gold plated on a copper substrate using the same conditions as in Example 1, the stripping rate was 1 to 1.2 microns per minute. Again, no attack on the copper substrate was detected.

EXAMPLE 3

The components of this aqueous stripping solution varied somewhat from Examples 1 and 2 by utilizing the following ingredients:

| Components | Concentration g/l |
|---|---|
| p-Nitrobenzoic Acid | 30 |
| Potassium Hydroxide | 15 |
| Lead Oxide | 0.5 |
| Potassium Cyanide | 15 |
| 2-Mercaptobenzothiazole | 1 |

The pH of the stripping solution was 12.5. When it was used to remove gold plated on a copper substrate using the conditions of Example 1, the stripping rate was up to 1 micron per minute. No attack on the copper substrate was observed.

The above data reveal the improved results attained by utilizing the organo mercapto additive to the gold stripping compositions. Not only was there a commercially acceptable gold stripping rate, but the prior art problem of attack on the copper substrate was avoided.

EXAMPLE 4

The procedure of the preceeding Examples 1–3 is repeated with the exception that in the composition used, mercaptobenzothiazolines, mercaptoimidazoles, mercapto-3-pyridinols, mercaptopyrimidines and mercaptobenzoxazoles, in amounts of 0.1, 0.5, 2.0, 3.0, 4.0 and 5.0 g/l were used in place of the 2-mercaptobenzothiazole and, sodium 3-methyl-2-nitrobenzoic acid; potassium 3-methyl-6-nitrobenzoic acid and sodium 4-chloro-3-nitrobenzoic acid, in amounts of 5, 10, 25, 40, 50 and 60 g/l, were used in place of the p-nitrobenzoic acid and/or potassium 2-chloro-4 nitrobenzoate. In each instance similar results are obtained.

In U.S. Pat. No. 3,102,808 which issued to Weisberg and Butler on June 3, 1963 there is a disclosure of using elemental sulfur as well as various sulfur compounds, including aromatic nitrogen sulfur compounds such as mercaptobenzothiazole, in a nickel stripping composition to accelerate the stripping operation. Weisberg and Butler also teach that the sulfur additive should be used in conjunction with a nitro organic compound and an amine in order to obtain commercial stripping rates. With some of the sulfur compounds, dissolution of copper, when it is employed as the substrate, was measurably and significantly suppressed.

There is, however, no disclosure whatsoever in the Weisberg and Butler patent pertaining to the gold stripping solutions or, more particularly, of the applicability of the invention to stripping gold or gold alloy deposits from copper substrates. In this connection, the later patents of Grunwald and Solidum did not recognize any relevancy of the Weisberg and Butler invention to the problems associated with stripping gold deposits from metal substrates such as copper.

Although Weisberg and Butler disclose the use of many different sulfur compounds to achieve their nickel stripping, it has been found that only the particular organo mercapto compounds delineated above are effective in the present invention.

It will be further understood that the examples set forth above are illustrative only, and that they are subject to further changes and modifications without departing from the broader aspects of this invention.

What is claimed is:

1. A composition for rapidly and selectively stripping gold or gold alloys deposited on a copper substrate, the composition comprising (a) a ring-substituted nitrobenzoic acid compound, (b) a bath soluble cyanide, (c) a lead or bismuth compound, and (d) an organo mercapto compound all of which components are present in amounts at least sufficient to provide, in combination, the desired gold stripping rate without substantial attack on said copper substrate.

2. The composition of claim 1 wherein the organo mercapto compound is selected from the group consisting or mercaptobenzothiazoles, mercaptobenzothiazolines, mercaptoimidazoles, mercapto-3-pyridinols, mercaptopyrimidines and mercaptobenzoxazoles.

3. The composition of claim 1 wherein the organo mercapto compound is 2-mercaptobenzothiazole.

4. The composition of claim 3 wherein the 2-mercaptobenzothiazole is present in an amount ranging from about 0.1 to 5 grams/liter.

5. The composition of claim 1 wherein the ring-substituted nitrobenzoic acid compound is selected from the group consisting of nitrobenzoic acid, alkali metal and ammonium salts of nitrobenzoic acid, 2-chloro-4-nitrobenzoic acid, alkali metal and ammonium salts of 2-chloro-4-nitrobenzoic acid.

6. The composition of claim 1 wherein the bath soluble cyanide is selected from the group consisting of alkali metal cyanides and ammonium cyanide.

7. The composition of claim 1 wherein the lead and bismuth compounds are selected from the group consisting of the halides, oxides, hydroxides, acetates and citrates.

8. In a composition for stripping gold metal deposits from a metal substrate, said composition comprising (a) a ring-substituted nitrobenzoic acid compound, (b) a bath soluble cyanide, and (c) a lead or bismuth compound; the improvement which comprises incorporating in said composition a sufficient amount of a mercaptobenzothiazole to rapidly strip the gold deposit from said substrate and to inhibit attack on the substrate by said composition.

9. The composition of claim 8 wherein said mercaptobenzothiazol is 2-mercaptobenzothiazole.

10. The method of stripping gold deposits from a copper substrate which comprises contacting a gold plated workpiece having a copper substrate with a gold stripping composition, having an alkaline pH, for a sufficient period of time to remove the gold from said workpiece at a rate of at least 1 micron per minute without attack on the copper substrate; said stripping composition comprising (a) a ring-substituted nitrobenzoic acid compound, (b) an alkali metal or ammonium cyanide, (c) a lead or bismuth compound, and (d) a mercapto organo compound selected from the group consisting of mercaptobenzothiazoles, mercaptobenzothiazolines, mercaptoimidazoles, mercapto-3-pyridinols, mercaptopyrimidines and mercaptobenzoxazoles.

11. the method of claim 10 wherein said contact is carried out by immersing said workpiece, having gold deposited thereon, in said stripping composition.

12. The method of claim 11 wherein said stripping composition is maintained at a temperature of from about 25° to 55° C. during said contact.

13. The method of claim 10 wherein the mercapto organo compound is 2-mercaptobenzothiazole.

14. The method of claim 13 wherein the 2-mercaptobenzothiazole is present in said stripping composition in an amount of from about 0.1 to 5 grams/liter.

15. The method of claim 10 wherein the stripping composition has a pH of from about 11 to 14.

* * * * *